US005875551A

United States Patent [19]

Huang

[11] Patent Number: 5,875,551

[45] Date of Patent: Mar. 2, 1999

[54] UTILITY KNIFE

[76] Inventor: Yin Han Huang, No. 4, Lane 342, Peng Yii Road, Tai Ping City, Taichung, Hsien, Taiwan

[21] Appl. No.: 900,505

[22] Filed: Jul. 25, 1997

Related U.S. Application Data

[63] Continuation-in-part of Ser. No. 441,992, May 16, 1995, abandoned.

[51] Int. Cl.[6] ..... B26B 3/06

[52] U.S. Cl. ..... 30/151; 30/162; 30/294; 30/335

[58] Field of Search ..... 30/162, 335, 294, 30/329, 332, 156, 339, 359, 337, 151, 152, 153, 160, 161, 122; 7/158, 165; D8/99

[56] References Cited

U.S. PATENT DOCUMENTS

| | | | |
|---|---|---|---|
| 2,286,524 | 6/1942 | Wiber | 30/161 |
| 3,660,895 | 5/1972 | West | 30/162 |
| 4,125,913 | 11/1978 | Lewis | 7/138 |
| 4,240,202 | 12/1980 | Gilbert | 30/162 |
| 4,517,741 | 5/1985 | Castelluzzo | 30/162 |
| 4,523,379 | 6/1985 | Osterhout et al. | 30/151 |
| 4,662,070 | 5/1987 | Reddig | 30/332 |
| 4,663,845 | 5/1987 | Weimann | 30/162 |
| 5,099,578 | 3/1992 | Jan | 30/162 |
| 5,155,911 | 10/1992 | Collins | 30/162 |
| 5,175,934 | 1/1993 | Chan | 30/329 |
| 5,303,469 | 4/1994 | Yin-han | 30/329 |

*Primary Examiner*—M. Rachuba
*Attorney, Agent, or Firm*—Charles E. Baxley, Esq.

[57] ABSTRACT

A knife includes two housings having a front portion for engaging with blades. One of the housings includes a projection formed in the front portion for engaging with a depression of the other housing so as to secure the front portions of the housings together. A rod is rotatably engaged in the rear portion of one of the housings. A cap is secured to one end of the rod, and a spring biases the cap to engage with the rear ends of the housings so as to secure the rear ends of the housings together. The housings can be secured together without additional tools.

6 Claims, 2 Drawing Sheets

UTILITY KNIFE

The present invention is a continuation-in-part of U.S. patent application Ser. No. 08/441,992, filed on May 16, 1995 now abandoned.

BACKGROUND OF THE INVENTION

1. Field of the Invention

The present invention relates to a knife, and more particularly to a utility knife.

2. Description of the Prior Art

Typical utility knives comprise two housings that have one end pivotally coupled together so as to allow the rotation of the housings one relative to the other, and that have the other end secured together by fastening members, particularly the screws. Three examples of the utility knives are disclosed in U.S. Pat. No. 4,517,741 to Castelluzzo, filed on May 19, 1992; U.S. Pat. No. 4,663,845 to Weimann, filed on Mar. 5, 1986; and U.S. Pat. No. 5,099,578 to January filed on May 7, 1991. An additional tool, such as screw driver, is required for unthreading the screws for disengaging the housings.

German Patent No. DE 2839067 also discloses a utility knife and includes a control knob rotatably engaged in the rear portion of the knife housings. However, the control knob includes only a small portion extended outward of the knife housings such that the control knob may not be easily operated. In addition, it will be difficult to assemble the control knob into the rear portion of the knife housing.

The present invention has arisen to mitigate and/or obviate the afore-described disadvantages of the conventional knives.

SUMMARY OF THE INVENTION

The primary objective of the present invention is to provide a utility knife which includes two housings that may be secured together without additional tool.

In accordance with one aspect of the invention, there is provided a knife comprising a lower housing including a front portion having a channel formed therein for engaging with a blade means, and including a rear portion having a rod slidably engaged therein, the lower housing including a rear end, the rod including a first end extended outward of the rear end of the lower housing, the lower housing including a first engaging means formed in the front portion thereof, an upper housing including a front portion for engaging with the channel so as to retain the blade means in place, including a second engaging means formed in the front portion for engaging with the first engaging means of the lower housing so as to secure the front portions of the lower housing and the upper housing together, the upper housing including a rear end for aligning with the rear end of the lower housing, a cap secured to the first end of the rod, and means for biasing the cap to engage with the rear ends of the upper housing and the lower housing so as to secure the rear ends of the upper housing and the lower housing together.

The rear end of the lower housing includes a first shoulder and a second shoulder formed therein, the first shoulder is located close to the front portion of the lower housing, and the second shoulder is provided for engaging with the cap so as to disengage the cap from the upper housing.

The lower housing includes a middle portion having a recess formed therein, the first engaging means is located between the recess and the channel, the upper housing includes a middle portion having a bulge formed thereon for engaging with the recess, the bulge includes a front portion, the second engaging means is formed on said front portion of the bulge for engaging with the first engaging means.

The housings each includes a slot formed therein for engaging with spare blade means. The housings each includes a puncture means formed therein for engaging with tool means.

The lower housing includes a groove formed in the rear portion thereof and includes a wall formed in the rear end thereof, the rod is engaged through the wall and rotatably engaged in the groove, the biasing means is biased between the rod and the wall so as to bias the cap and the rod toward the front portion of the lower housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
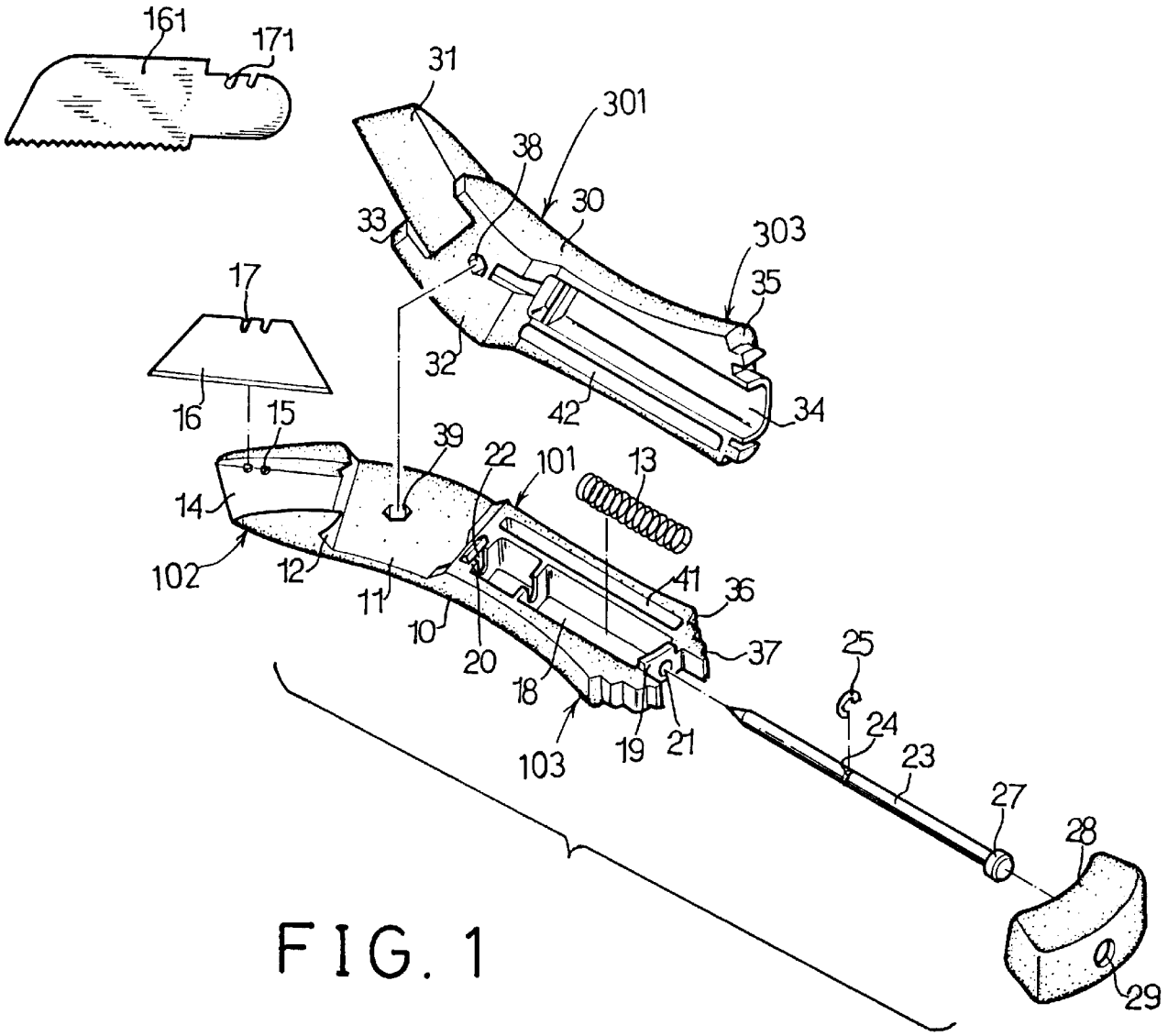
FIG. 1 is an exploded view of a utility knife in accordance with the present invention.
Figure 2:
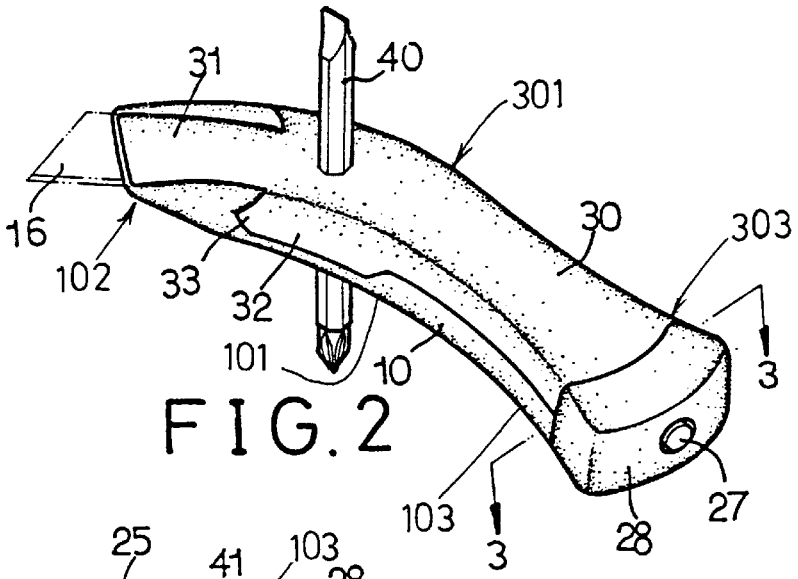
FIG. 2 is a perspective view of the utility knife.
Figure 3:
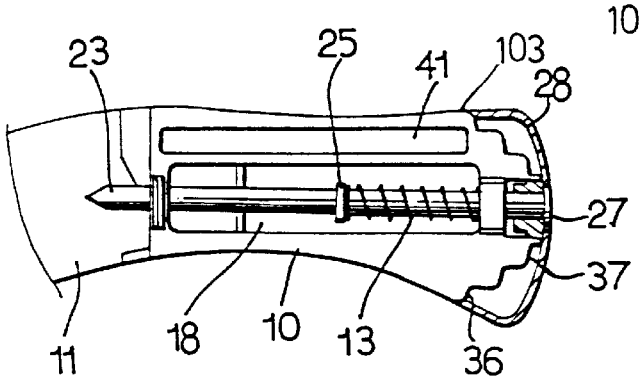
FIGS. 3 and 4 are cross sectional views taken along lines 3—3 of FIG. 2.

Referring to the drawings, and initially to FIGS. 1 to 3, a utility knife in accordance with the present invention comprises a lower housing 10 including a recess 11 formed in the middle portion 101 and including a channel 14 formed in the front portion 102 for engaging with a blade 16 or a saw blade 161. The blade 16 and the saw blade 161 each includes two notches 17, 171, respectively, for engaging with two lumps 15 formed in the channel 14. A first engaging means, such as an engaging depression means 12 is formed in the front portion 102 of the lower housing 10 and located between the recess 11 and the channel 14. A groove 18 is formed in the rear portion 103 of the lower housing 10 for receiving a biasing means, such as a spring 13 and includes a rear wall 19 and a front wall 20 each having a hole 21, 22, respectively, formed therein for engaging with and for rotatably supporting a rod 23 therein. The rod 23 includes an annular slot 24 formed in the middle portion for engaging with a clamping ring 25 and includes a head 27 formed on a first end and extended outward of the lower housing 10. A cap 28 has a stepped hole 29 formed therein for engaging with the head 27 so as to be coupled to the rod 23. The spring 13 is biased between the clamping ring 25 and the wall 19 of the lower housing 10 so as to bias the cap 28 to engage with the rear portion 103 of the lower housing 10. The rear portion 103 of the lower housing 10 includes a first and a second shoulders 36, 37 formed therein, in which the first shoulder 36 is located closer to the front portion 102 of the lower housing 10.

An upper housing 30 includes a front portion 31 for engaging with the channel 14 so as to retain the blade 16, 161 in place, and includes a bulge 32 formed in the middle portion 301 for engaging with the recess 11 of the lower housing 10. A second engaging means, such as an engaging projection means 33 is provided on the front portion of the bulge 32 for engaging with the engaging depression means 12 so as to secure the front portions 102, 31 of the housings

10, 30 together. The upper housing 30 includes a groove 34 formed in the rear portion 303. The housings 10, 30 each includes a slot 41, 42 formed therein for receiving spare blades therein, and each includes an engaging puncture 38, 39, respectively, formed therein for engaging with a screw driver 40 or a driving rod of a wrench. The rear portion 303 of the upper housing 30 includes a shoulder 35 formed therein and aligned with the shoulder 36 of the lower housing 10, best shown in FIG. 5, for engaging with the cap 28.

In operation, as shown in FIG. 3, the cap 28 is biased by the spring 13 in order to engage with the shoulders 35, 36 of the housings so as to secure the rear portions 103, 303 of the housings together. The front portions 102, 31 of the housings 10, 30 are secured together by the engaging means 12, 33 of the housings.

Figure 4:
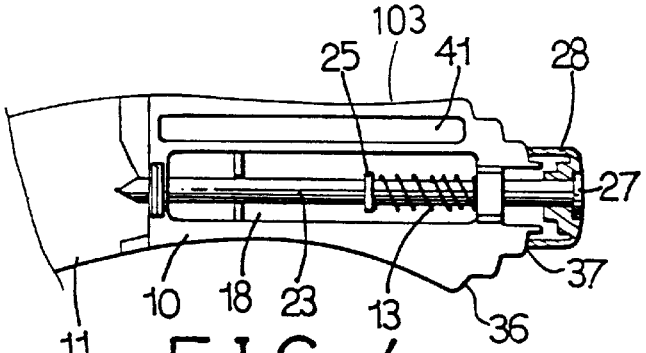
Figure 5:
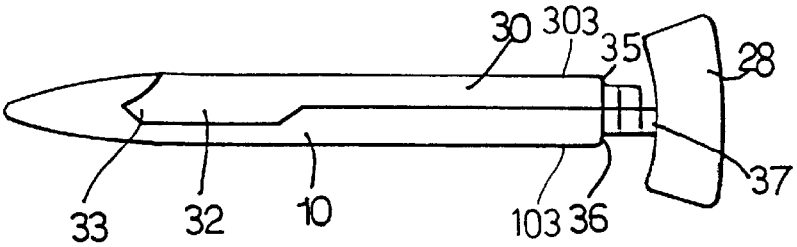
FIG. 5 is a front view illustrating the operation of the utility knife.

When it is required to disengage the housings 10, 30, it is only required to pull the cap 28 rearward against the spring 13 and to rotate the cap 28 for about 90 degrees so as to engage the cap 28 with the shoulder 37 of the lower housing 10, as shown in FIGS. 4 and 5. The upper housing 30 is then disengaged from the cap 28 and may be easily removed and disengaged from the lower housing 10.

Accordingly, the utility knife in accordance with the present invention includes two housings that may be secured together without additional tools and that may be easily disengaged from each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A knife comprising:

a lower housing including a front portion having a channel formed in said front portion, and including a rear portion having a rod slidably engaged in said rear portion, said rod including a first end extended outward of said rear portion of said lower housing, said lower housing including a first engaging means formed in said front portion of said lower housing, a blade engaged in said channel of said lower housing, an upper housing including a front portion for engaging with said channel of said lower housing and for engaging with said blade, including a second engaging means formed in said front portion for engaging with said first engaging means of said lower housing, said upper housing including a rear portion for aligning with said rear portion of said lower housing, a cap secured to said first end of said rod, and spring biasing means for biasing said cap to engage with said rear portions of said upper housing and said lower housing and for securing said rear portions of said upper housing and said lower housing together.

2. A knife according to claim 1, wherein said rear portion of said lower housing includes a first shoulder and a second shoulder, said first shoulder is located closer to said front portion of said lower housing, and said second shoulder is provided for engaging with said cap.

3. A knife according to claim 1, wherein said lower housing includes a middle portion having a recess formed in said middle portion, said first engaging means is located between said recess and said channel, said upper housing includes a middle portion having a bulge for engaging with said recess, said bulge includes a front portion, said second engaging means is formed on said front portion of said bulge for engaging with said first engaging means.

4. A knife according to claim 1, wherein said upper housing and lower housing each includes a slot formed therein for engaging with spare blade means.

5. A knife according to claim 1, wherein said upper housing and lower housing each includes a non-circular puncture.

6. A knife according to claim 1, wherein said lower housing includes a groove formed in said rear portion and includes a wall formed in said rear portion, said rod is engaged through said wall and rotatably engaged in said groove, said biasing means is engaged between said rod and said wall for biasing said cap and said rod toward said front portion of said lower housing.

* * * * *